US007245848B2

(12) United States Patent
Friedrich et al.

(10) Patent No.: US 7,245,848 B2
(45) Date of Patent: Jul. 17, 2007

(54) METHOD AND APPARATUS FOR DISCHARGING A CONDUCTIVE BRUSH CLEANING ASSEMBLY FOR A TRANSFER ROLLER

(75) Inventors: Kenneth P. Friedrich, Honeoye, NY (US); George R. Walgrove, Rochester, NY (US); Gary B. Bertram, Honeoye Falls, NY (US); Ronald E. Auty, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 208 days.

(21) Appl. No.: 11/087,309

(22) Filed: Mar. 23, 2005

(65) Prior Publication Data

US 2005/0214021 A1 Sep. 29, 2005

Related U.S. Application Data

(60) Provisional application No. 60/556,751, filed on Mar. 26, 2004.

(51) Int. Cl.
*G03G 15/16* (2006.01)

(52) U.S. Cl. ..... 399/101; 399/121

(58) Field of Classification Search ..... 399/91, 399/98, 99, 101, 107, 121
See application file for complete search history.

(56) References Cited

U.S. PATENT DOCUMENTS

| | | | | |
|---|---|---|---|---|
| 3,847,119 | A * | 11/1974 | Hoffman et al. | 399/101 |
| 5,101,238 | A | 3/1992 | Creveling et al. | 355/271 |
| 5,937,254 | A | 8/1999 | Maher et al. | 399/297 |
| 6,009,301 | A | 12/1999 | Maher et al. | 399/353 |
| 6,074,756 | A | 6/2000 | Vreeland et al. | 428/423.1 |
| 6,175,711 | B1 * | 1/2001 | Yoshino et al. | 399/297 |
| 6,381,427 | B1 | 4/2002 | Bertram et al. | 399/101 |
| 6,549,747 | B2 | 4/2003 | Brown et al. | 399/353 |

* cited by examiner

*Primary Examiner*—Hoan Tran
(74) *Attorney, Agent, or Firm*—Richard A. Romanchik

(57) ABSTRACT

An electrophotographic machine includes a dielectric member configured for carrying a toner image. A transfer roller engages the dielectric member and transfers the toner image to an image substrate. A transfer roller power supply biases and periodically reverse biases the transfer roller. A transfer roller cleaning brush having conductive bristles engages the transfer roller. An electrically conductive brush housing encloses the transfer roller cleaning brush and defines an opening through which the bristles contact the transfer roller. The brush housing is electrically charged to the same electrical potential as said transfer roller and is selectively discharged.

12 Claims, 9 Drawing Sheets

METHOD AND APPARATUS FOR DISCHARGING A CONDUCTIVE BRUSH CLEANING ASSEMBLY FOR A TRANSFER ROLLER

CROSS-REFERENCE TO RELATED APPLICATIONS

This application claims the benefit of U.S. Provisional Patent Application No. 60/556,751, filed Mar. 26, 2004.

FIELD OF THE INVENTION

The present invention relates generally to electrophotographic printing and/or copying machines. More particularly, the present invention relates to a method and apparatus for cleaning the transfer roller in such machines.

BACKGROUND OF THE INVENTION

In modern high-speed/high-quality electrophotographic machines, such as copiers and printers, a latent image charge pattern is formed on a dielectric member, such as an endless-loop belt. Pigmented toner particles are drawn by electrostatic attraction onto the latent image charge pattern to develop the image carried on the dielectric member. A receiver sheet or image substrate, such as, for example, a piece of paper, is then brought into contact with the image on the support member. An electric field is applied to transfer the image from the support member to the image substrate. Thereafter, the image substrate carrying the transferred image is separated from the dielectric support member and the image is fixed to the substrate, such as, for example, by fusing.

One way in which the electric field is applied to effect transfer of the image from the support member to the image substrate is the use of a roller-type transfer station or sub-system wherein a transfer roller is in engagement with the dielectric member. The transfer roller is electrostatically biased and causes the transfer of the charged toner particles from the surface of the dielectric member to the image substrate as the image substrate passes between the transfer roller and the dielectric member. During operation, however, residual toner and other particulate material, such as paper dust, is sometimes picked up by and/or attracted to the biased transfer roller. These particles can be transferred onto the back surface of the next image substrate and create undesirable marks thereon. Therefore, the transfer roller is continuously and automatically cleaned by a cleaning mechanism.

The cleaning mechanism is typically an elongate cylindrical fiber cleaning brush, and is electrically non-conductive. The cleaning brush and transfer roller are generally in relatively close proximity with parallel central axes. The fiber cleaning brush engages the surface of the transfer roller with a force that is calculated to achieve relatively efficient cleaning of the transfer roller surface. A motor drives the cleaning brush to rotate in the area of contact between the cleaning brush and the transfer roller in a direction opposite to the direction in which the transfer roller is rotated, and thereby increases the effectiveness with which the cleaning brush removes particles from the surface of the transfer roller.

Despite the above-described measures to improve the effectiveness with which the cleaning brush removes or cleans the transfer roller, a typical cleaning brush is relatively inefficient and requires multiple passes in order to clean even a moderately contaminated roller. A conventional cleaning brush may typically have a maximum cleaning efficiency of less than approximately ten percent.

Therefore, what is needed in the art is a transfer roller cleaning brush having an improved cleaning efficiency.

BRIEF DESCRIPTION OF THE DRAWINGS

The above-mentioned and other features and advantages of this invention, and the manner of attaining them, will become apparent and be better understood by reference to the following description of one embodiment of the invention in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE DRAWINGS

Figure 1:
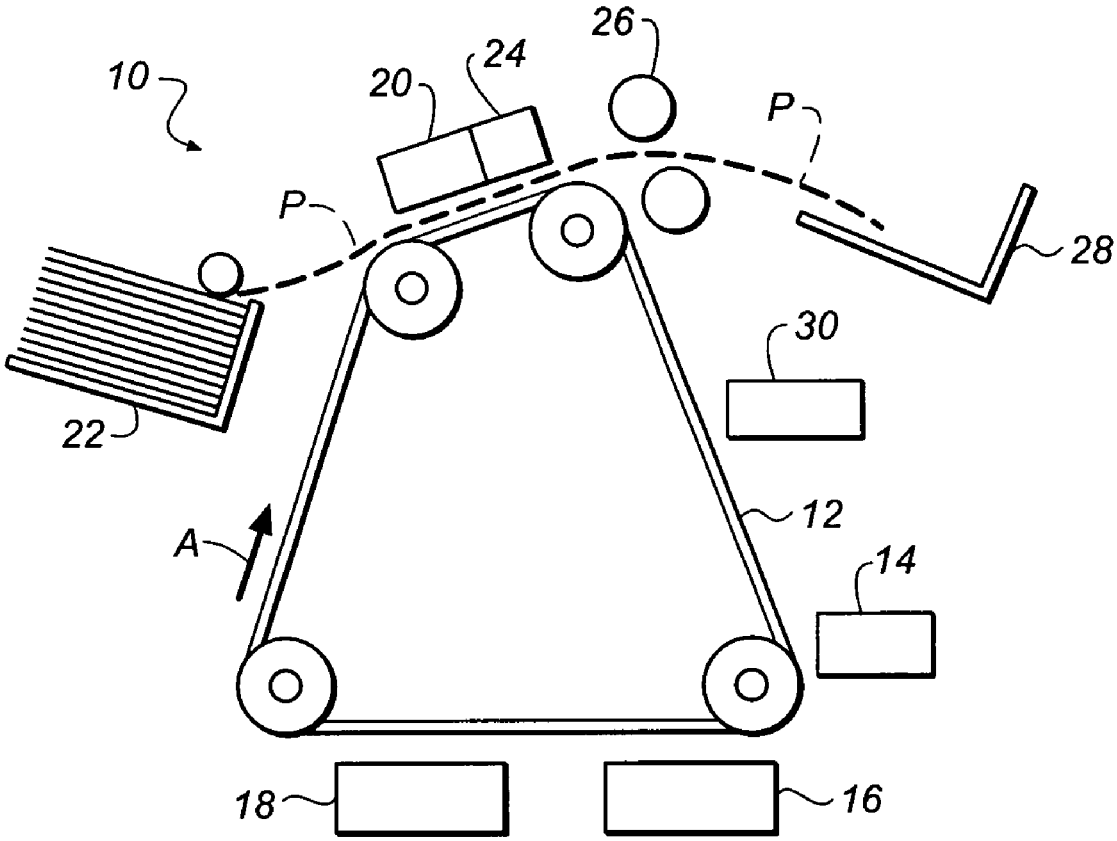
FIG. 1 is a schematic illustration of a typical electrophotographic machine.

Referring now to FIG. 1, a schematic diagram of a conventional electrophotographic machine is shown. Machine 10, such as, for example, a copier or printer, includes dielectric member 12, charging station 14, exposure station 16, development station 18, transfer station 20, paper supply 22, paper detach mechanism 24, fusing station 26, output hopper 28, and cleaning station 30.

Generally, in use, machine 10 moves dielectric support 12 past and/or through charging station 14 wherein a uniform charge is applied thereto. Dielectric support 12 is thereafter moved past and/or through exposure station 16 wherein the uniform charge is altered to form a latent image charge pattern (not shown) corresponding to the information desired to be printed and/or reproduced. The latent image charge pattern is carried by dielectric member 12 into development station 18, wherein pigmented marking particles (i.e., toner) are brought into close association with and electrostatically drawn to the latent image charge pattern thereby creating a developed image on dielectric member 12. Transfer station 20 generates an electric charge to transfer the toner of the developed image carried on dielectric member 12 to an image substrate, such as, for example, a piece of paper, fed from hopper 22 into and through transfer station 20 along path P. Detach mechanism 24 facilitates removal of the image substrate from dielectric member 12. Fusing station 26 fixes the toner particles to the image substrate by, for example, heat and/or pressure, and delivers the image substrate to output hopper 28. The dielectric support 12 is then cleaned by cleaning station 30.

Figure 2:
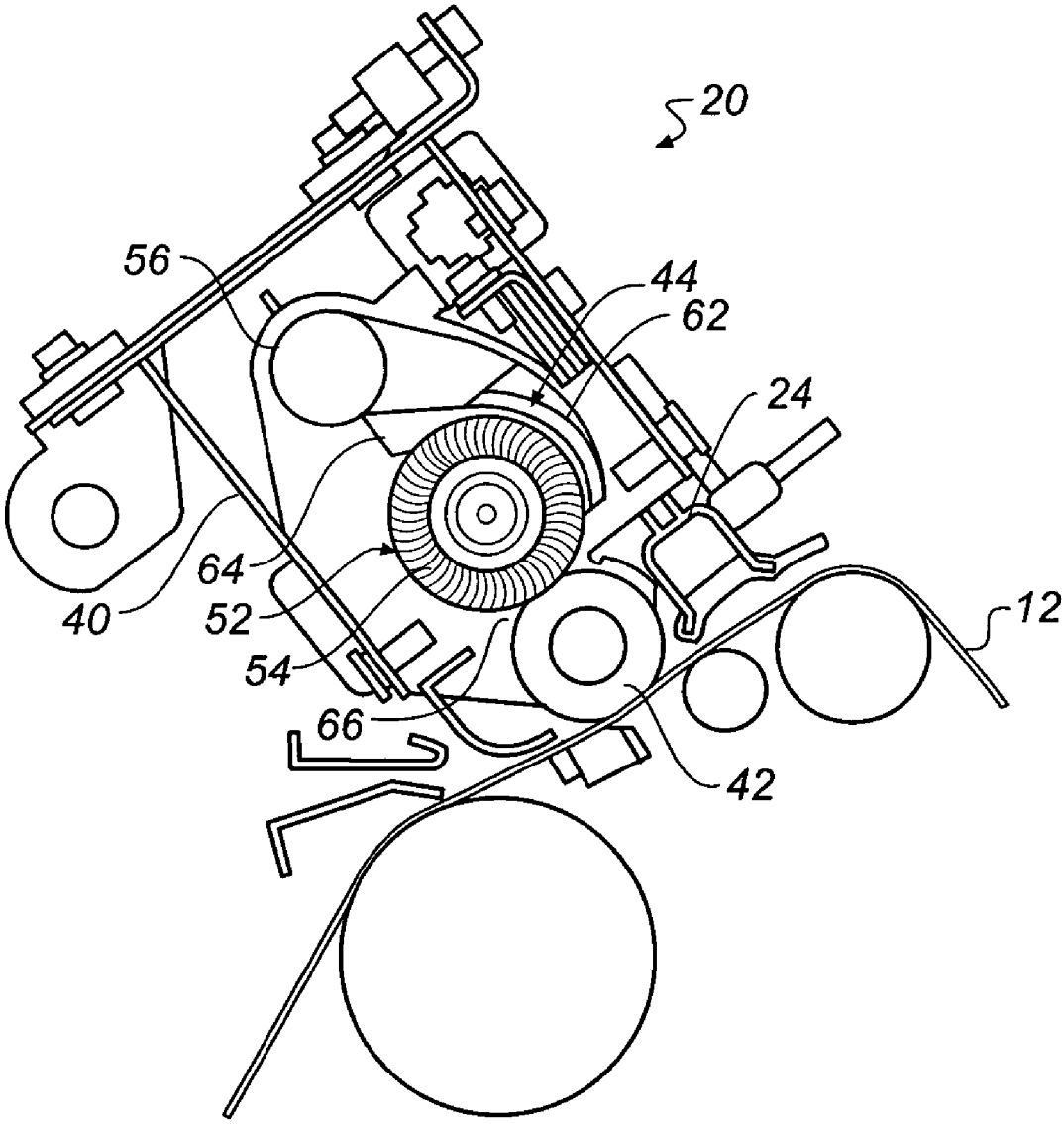
FIG. 2 is a side view of a roller transfer station or sub-system of the electrophotographic machine of FIG. 1.

Referring now to FIG. 2, the roller transfer station or sub-system 20 of electrophotographic machine 10 is shown in more detail. Roller transfer station 20 includes a housing 40 within which is disposed a transfer roller 42 and a roller cleaning mechanism 44. In the embodiment shown, detach mechanism 24 is also disposed within housing 40.

Transfer roller 42 engages dielectric member 12. An electrical bias is applied to the conductive core (not referenced) of transfer roller 42 by a power supply (not shown), such as, for example, a voltage-limited constant current source power supply. The electrical bias establishes the above-described electrical transfer field that will efficiently transfer a developed image from the dielectric member to a receiver member passing between dielectric member 12 and the semi-conductive surface (not referenced) of transfer roller 42. When the outer surface of transfer roller 42 contacts dielectric member 12 with no image substrate in between, transfer roller 42 tends to pick up and/or attract residual toner and/or paper dust/particles from dielectric member 12. Transfer roller 42 may be more severely contaminated when a misfeed of an image substrate occurs. In such an instance, virtually the entire developed toner image will be transferred from the dielectric member 12 to the outer surface of transfer roller 42. The residual toner and other contaminant particles can be transferred from transfer roller 42 onto the back side/surface of the next image substrate to be processed through roller transfer station 20 and thereby form undesirable marks thereon. Therefore, transfer roller 42 is cleaned by cleaning mechanism 44 which removes the residual toner and/or paper dust particles and thereby prevents the deposition thereof onto the back sides of the image substrates.

Cleaning mechanism 44 includes an elongated, cylindrical, fiber brush 52 having fiber bristles 54. Brush 52 is disposed within and supported by housing 40 such that the longitudinal axis (not referenced) of brush 52 is parallel to and spaced a predetermined distance apart from the longitudinal axis (not referenced) of transfer roller 42. Bristles 54 engage transfer roller 42 with a predetermined amount engagement that, dependent at least in part upon the density of brush 52 and its speed of rotation, is intended to maximize the efficiency with which brush 52 cleans transfer roller 42. Motor 56 is coupled to housing 40 and rotates brush 52 in a direction such that brush 52 and transfer roller 42 are rotating in opposite directions in the area of contact. Vacuum 62 is associated with brush 52 to remove cleaned particles from the fibers/bristles thereof, the particles being deposited in a downstream collection container (not shown).

Cleaning mechanism 44 also includes brush housing 64. Brush housing 64 is in communication with a vacuum-generating blower (not referenced), and forms an air-flow-directing chamber in close proximity to a portion of the periphery of brush 52. Brush housing 64 defines an opening 66 to brush 52 through which bristles 54 thereof engage transfer roller 42. Brush housing 64 is typically formed of a conductive plastic in order to prevent the build up of static electrical charge from the rotating brush therein and the air flow therethrough.

The foregoing is a general description of one embodiment of a conventional electrophotographic machine having one embodiment of a roller transfer station or sub-system. A more detailed description thereof is provided in U.S. Pat. Nos. 5,101,238 and 6,381,427, the disclosures of which are incorporated herein by reference.

Figure 3:
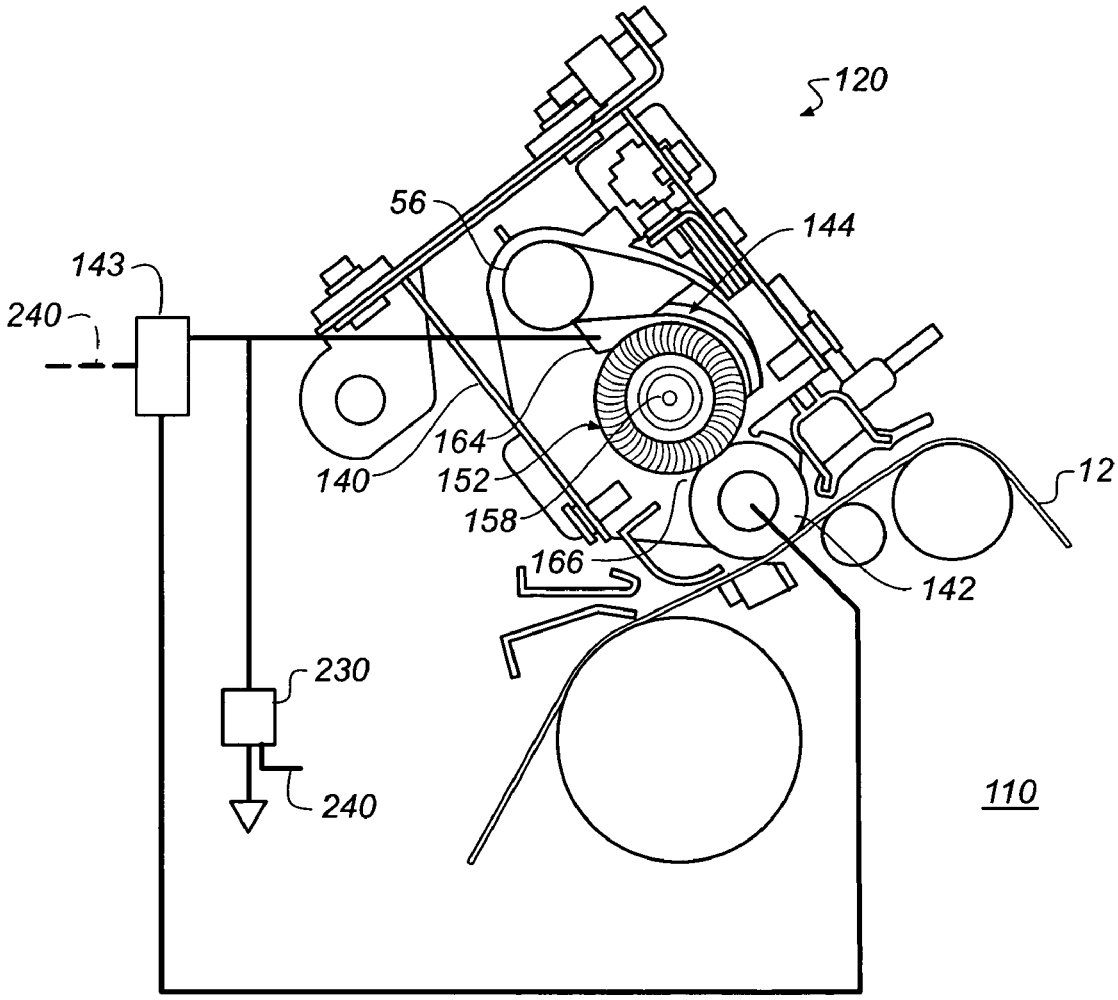
FIG. 3 is a side view of a roller transfer station or sub-system of the present invention.

Referring now to FIG. 3, an electrophotographic machine 110 including one embodiment of a roller transfer station or sub-system of the present invention is shown. Roller transfer station 120 includes several component parts that are common with and/or substantially similar to those of roller transfer station 20, and corresponding reference characters are used to indicate those corresponding parts. Roller transfer station 120 includes a housing 140 which encloses transfer roller 142 and transfer roller cleaning mechanism 144.

Transfer roller 142, much like transfer roller 42 described above, has an electrically-conductive inner core (not referenced) and a semi-conductive outer surface (not referenced), typically polyurethane, that engages dielectric member 12. The outer surface of transfer roller 142 may be coated, as described in U.S. Pat. No. 6,074,756, or uncoated. An electrical bias is applied to the conductive core of transfer roller 142 by transfer roller power supply 143, such as, for example, a voltage-limited constant current source. The electrical bias establishes the above-described electrical transfer field that transfers the developed image from dielectric member 12 to a receiver member passing between dielectric member 12 and transfer roller 142. When the outer surface of transfer roller 142 contacts dielectric member 12 with no image substrate there between, transfer roller 142 tends to pick up and/or attract residual toner and/or paper dust/particles from dielectric member 12 in much the same manner as described above in regard to transfer roller 42. These particles are removed from transfer roller 142 by cleaning mechanism 144.

Figure 4:
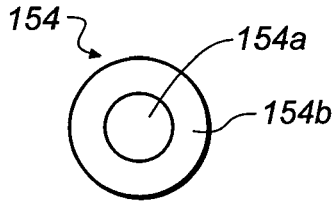
FIG. 4 is a cross-sectional view of an individual fiber of the cleaning brush of FIG. 3.
Figure 5:
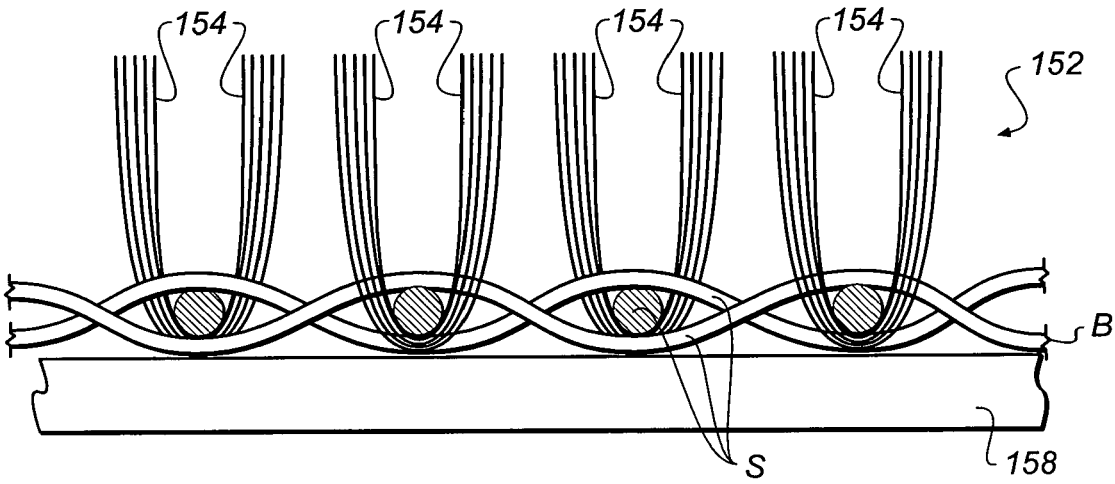
FIG. 5 is a side, elevational view of the weave of the cleaning brush of FIG. 3.

Cleaning mechanism 144 includes an elongated, cylindrical, transfer roller cleaning brush 152 having, as best shown in FIGS. 4 and 5, a plurality of electrically-conductive fibers or bristles 154 and a brush core 158. Fibers 154 are attached or otherwise connected to and extend in a generally radial direction from brush core 158. Brush core 158 is constructed of an electrically nonconductive material, such as, for example, cardboard. Transfer roller cleaning brush 152 is disposed within and supported by housing 140 such that the longitudinal axis (not referenced) of brush 152 is parallel to and spaced a predetermined distance apart from the longitudinal axis (not referenced) of transfer roller 142. Transfer roller cleaning brush 152 is electrically isolated relative to housing 140.

Cleaning mechanism 144 also includes brush housing 164. Brush housing 164, much like brush housing 64, is in communication with a vacuum-generating blower (not referenced), and forms an air-flow-directing chamber in close proximity to a portion of the periphery of brush 152. Brush housing 164 defines an opening 166 to brush 152 through which bristles 154 contact transfer roller 142. Brush housing 164 is electrically conductive and has a resistivity of, for example, from approximately $10^3$ to approximately $10^5$ ohms-cm. Generally, and as will be more particularly described hereinafter, brush housing 164 is electrically charged to the same potential as transfer roller 142.

Fibers or bristles 154 engage transfer roller 142 through an opening 166 in brush housing 164 and engage transfer roller 142 with a predetermined amount engagement that is dependent at least in part upon the density of brush 152 and its speed of rotation, and is intended to substantially maximize the efficiency with which brush 152 mechanically cleans transfer roller 142. Motor 56 is coupled to housing 140 and rotates brush 152 in a direction such that brush 152 and transfer roller 142 are rotating in opposite directions in the area of contact. A vacuum (not shown) is also associated with brush 152 and brush housing 164 to remove cleaned particles from the fibers/bristles 154, the particles being deposited in a downstream collection container (not shown).

As best shown in FIG. 4, fibers/bristles 154 of brush 152 preferably include an inner conductive central core 154*a* and a non-conductive peripheral portion 154*b* surrounding conductive central core 154*a*. One embodiment of such a brush is more particularly described in U.S. Pat. Nos. 5,937,254 and 6,009,301, the disclosures of which are incorporated herein by reference and which describe the use of such a brush in association with an intermediate transfer member. As is more particularly described therein, and as shown in FIG. 5, brush 152 is weaved into a backing strip B having fibers S, at least some of which have an electrically conductive periphery. A conductive mat is thus formed that provides a mechanism of inductively charging and/or discharging the conductive cores 154*a* of fibers/bristles 154 without requiring an ohmic contact thereto. The conductive backing strip B is then attached, such as, for example, by epoxy, to brush core 158.

U.S. Pat. No. 6,549,747, the disclosure of which is also incorporated herein by reference, discloses a conductive cleaning brush that is associated with a biased intermediate transfer member (ITM). As described therein, the conductive brush is biased to a voltage of the same polarity as but a greater magnitude than the voltage to which the intermediate transfer member is biased, and to a polarity opposite the polarity of the toner/marking particles, in order to electrostatically draw toner and other particles from the ITM to the cleaning brush. The brush housing that encloses the conductive cleaning brush is permitted to electrically float or accumulate the charge carried by the toner/marking particles (i.e., the same magnitude and polarity), and thereby repels additional toner/marking particles.

In contrast, and as is more particularly described hereinafter, the conductive transfer roller cleaning brush of the present invention is associated with a biased transfer roller (rather than an intermediate transfer roller). Use of a conductive cleaning brush with a biased transfer roller has heretofore been problematic because contacting the transfer roller with a conductive brush creates a path through which current intended to accomplish image transfer is instead bled off from the biased transfer roller to ground thereby undesirably reducing the current available to accomplish image transfer and adversely impacting image quality. Although the amount of current sourced to transfer roller 142 can be increased to compensate for the bleed off of transfer current, doing so is an imperfect solution since the electrical load presented by transfer roller 142 and the transfer current required for quality image transfer both vary widely due to various operating conditions and parameters, such as, for example, temperature, humidity, thickness of the image substrate or paper being used, etc.

Generally, the present invention utilizes a charging mechanism to charge the conductive transfer roller cleaning brush and/or the conductive brush housing that encloses the conductive transfer roller cleaning brush to the same electrical polarity and substantially the same magnitude to which the transfer roller is charged (and to the opposite polarity as the marking particles/toner). By charging the conductive transfer roller cleaning brush and/or brush housing to substantially the same magnitude and polarity as the transfer roller the present invention substantially reduces and/or eliminates the image-degrading flow of transfer current away from the transfer roller.

Figure 6:
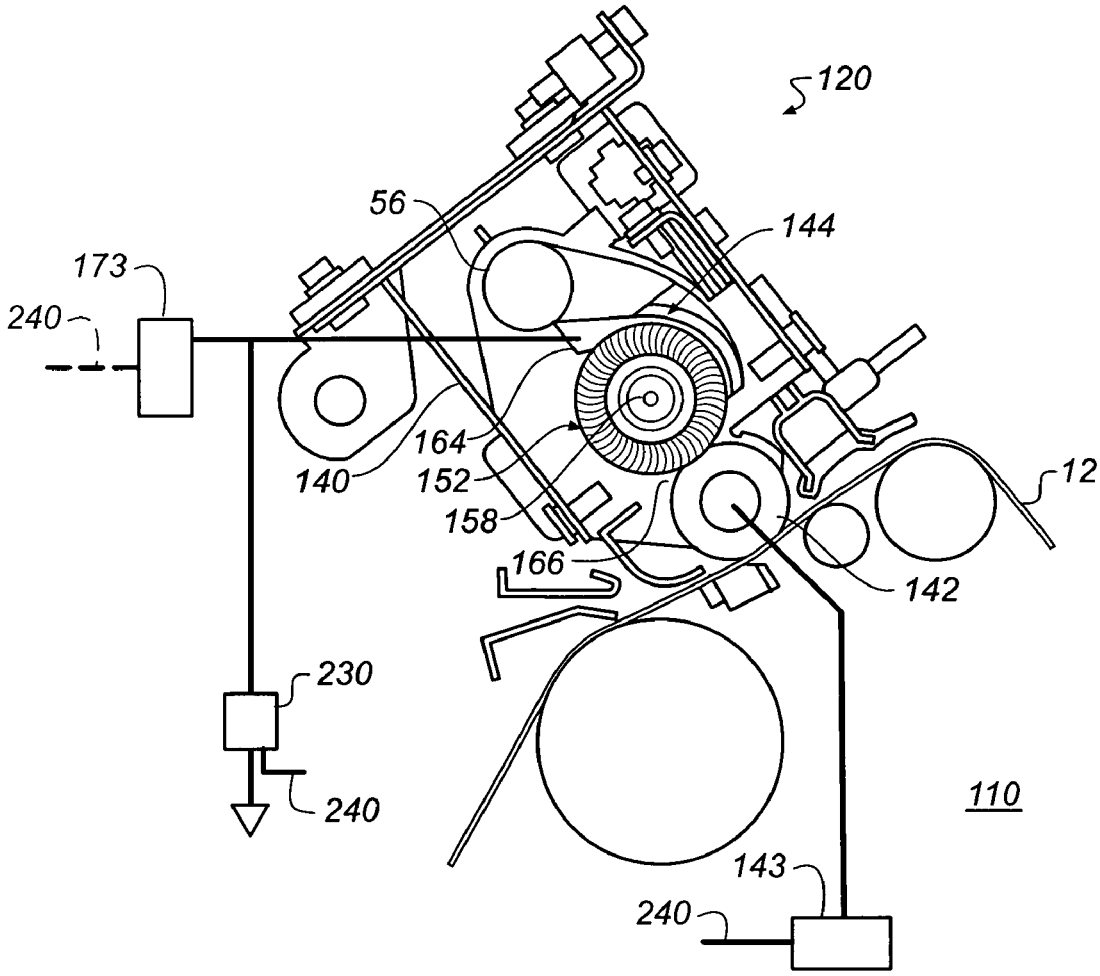
FIG. 6 is a side view of a second embodiment of a roller transfer station or sub-system of the present invention.

Referring again to FIG. 3, conductive brush housing 164 of roller transfer station 120 is electrically connected to and biased by transfer roller power supply 143 to substantially the same potential and polarity as transfer roller 142. Alternatively, and as shown in FIG. 6, conductive brush housing 164 is electrically connected to and biased to the same potential and polarity as transfer roller 142 by a separate power supply 173. It should be particularly noted, however, that power supply 173 must be slaved to or closely follow the power output of transfer roller power supply 143 in order to ensure that conductive brush housing 164 and transfer roller 142 are maintained at the same potential.

In either of the embodiments described above and shown in FIGS. 3 and 6, conductive brush housing 164 is charged to substantially the same magnitude and polarity as transfer roller 142. Thus, the image-degrading flow of transfer current from transfer roller 142 to conductive brush 152 and/or brush housing 164 is substantially reduced.

More particularly, a certain amount of transfer current $I_{TRANS}$ is required to achieve a high-quality and efficient transfer of the developed image from dielectric member 12 to the image substrate. Transfer current $I_{TRANS}$ is, for example, typically from approximately 40 to approximately 60 microamperes. However, engaging and/or cleaning biased transfer roller 142 with conductive transfer roller cleaning brush 152 will cause transfer current $I_{TRANS}$ to be reduced by a cleaning current $I_{CLEAN}$ that flows from transfer roller 142 through conductive transfer roller cleaning brush 152. Cleaning current $I_{CLEAN}$ can be as high as, for example, 30-40 microamperes. Transfer current $I_{TRANS}$ is thus reduced by the cleaning current $I_{CLEAN}$, and poor-quality image transfer may therefore result. Biasing brush housing 164 to substantially the same magnitude and polarity as transfer roller 142 substantially reduces the magnitude of cleaning current $I_{CLEAN}$ and thereby acts to maintain transfer current $I_{TRANS}$ at an acceptable level.

Figure 7:
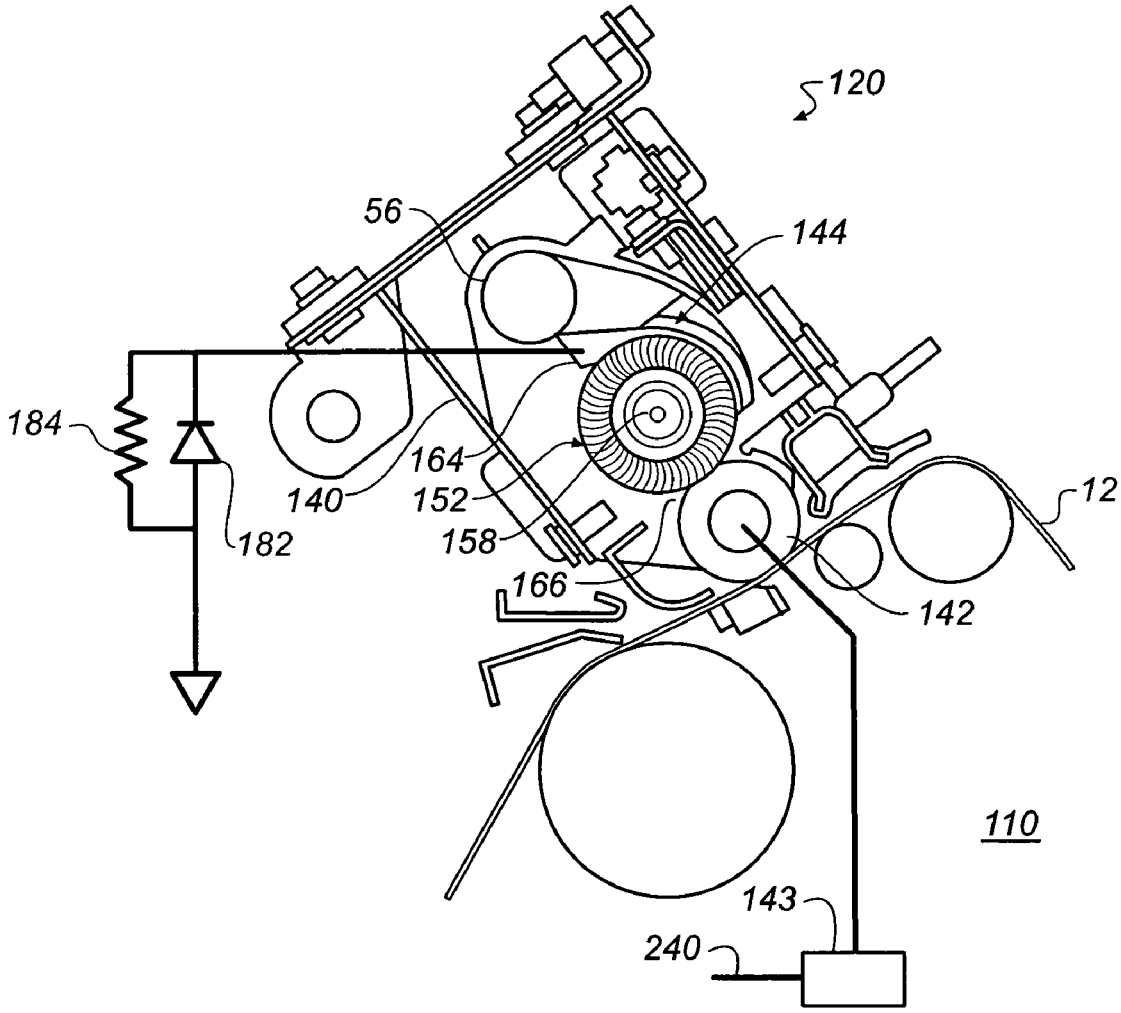
FIG. 7 is a side view of another embodiment of a roller transfer station or sub-system of the present invention.

Referring now to FIG. 7, another embodiment of a roller transfer station of the present invention is shown wherein conductive brush housing 164 is electrically connected to ground through a high-voltage diode 182 in parallel with a current-limiting discharge resistor 184. Diode 182 is, for example, rated at 5 kilovolts and 25 milliamps. One example of such a diode is part number G5FS, available from HV Component Associates of Farmingdale, N.J. Diode 182 permits the conductive brush housing 164 to electrically float and, through contact with or by close proximity to bristles 154 of conductive transfer roller cleaning brush 152, acquire the potential of transfer roller 142. When the polarity of transfer roller 142 is reversed (i.e., from positive to negative in the exemplary embodiment), such as, for example, during a cleaning cycle of the transfer roller and/or during start up or shut down of machine 110, brush housing 164 is also charged to or acquires that reversed polarity. The reversed polarity of brush housing 164, in turn, forward biases diode 182 which connects brush housing 164 to ground potential, and thereby enables the discharge of brush housing 164.

The resistance value of discharge resistor 184, such as, for example, from approximately one to three gigaohms, is chosen to enable the conductive brush housing 164 to electrically discharge in an acceptable period of time and at an acceptable/safe level of current in emergency shut down situations. In the embodiment of FIG. 7, conductive transfer roller cleaning brush 152 is electrically floating and acquires the same potential as transfer roller 142 through contact with or close proximity to conductive transfer roller 142.

Figure 8:
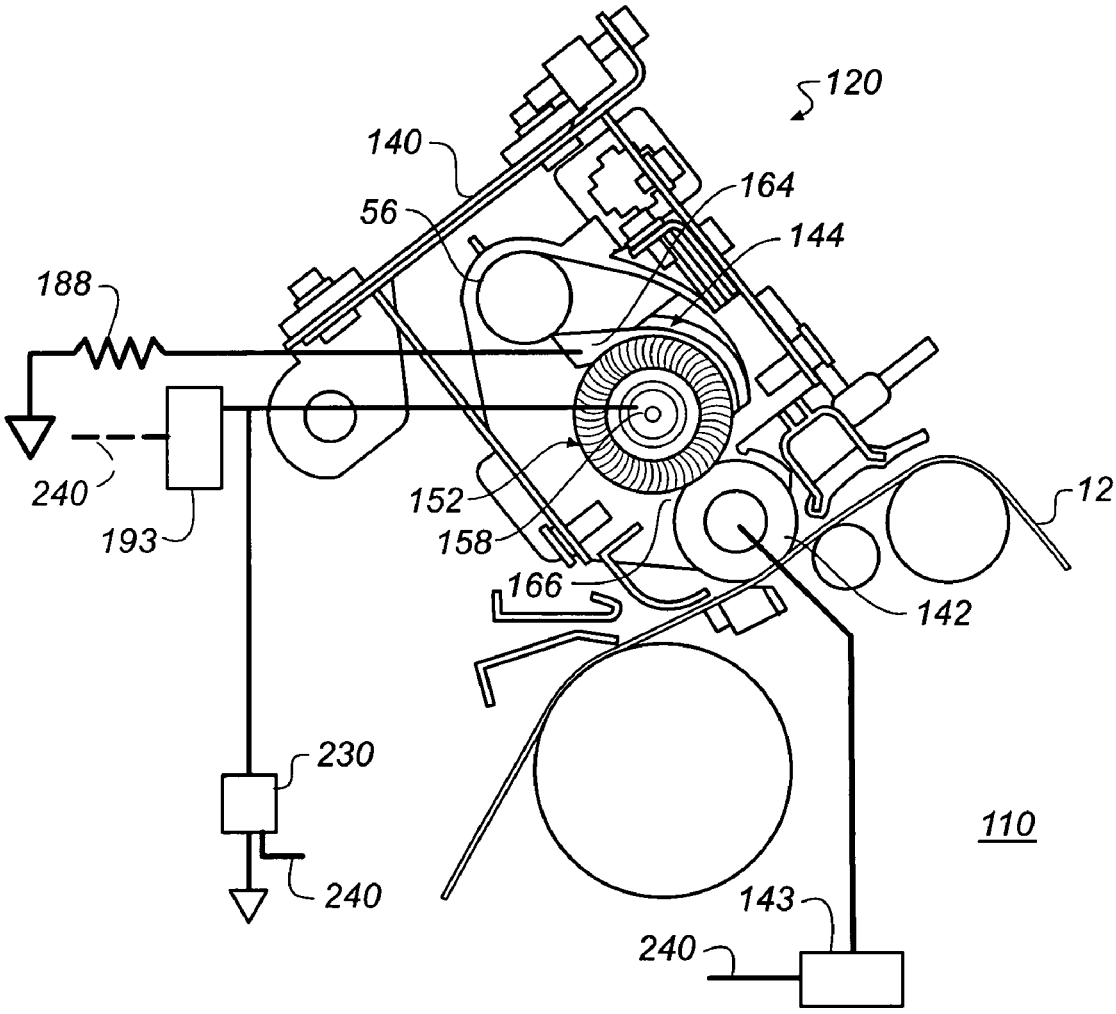
FIG. 8 is a side view of yet another embodiment of a roller transfer station or sub-system of the present invention.

Referring now to FIG. 8, a further embodiment of a roller transfer station of the present invention is shown wherein conductive brush housing 164 is electrically connected to ground potential through a current-limiting resistor 188 and thus is not permitted to float electrically. This embodiment requires that conductive transfer roller cleaning brush 152 be electrically connected to and biased to the same potential as transfer roller 142 by power supply 193, which is separate from transfer roller power supply 143. Power supply 193 supplies the current that will flow from conductive transfer roller cleaning brush 152 to ground through conductive brush housing 164, and thereby prevents any undesirable reduction in the transfer current provided to transfer roller 142 by transfer roller power supply 143 and the adverse affects on image quality that result therefrom.

It should be particularly noted, however, that power supply 193 must be slaved to or closely follow the power output of transfer roller power supply 143 in order to ensure that conductive transfer roller cleaning brush 152 and transfer roller 142 are maintained at the same potential.

It should further be particularly noted that in the configuration wherein each of conductive brush housing 164 and transfer roller cleaning brush 152 are electrically floating and/or isolated they may each be biased to the same potential as transfer roller 142 by the same power supply or separate power supplies, and/or by transfer roller power supply 143.

In all the above-described embodiments of machine 110 and transfer station 120, conductive brush housing 164 and transfer roller 142 are either directly biased or charged to an electrical potential of substantially the same polarity and magnitude in order to prevent or substantially reduce the image-degrading affects of the flow of current from transfer roller 142 to conductive transfer roller cleaning brush 152 and/or conductive brush housing 164.

At various points during the operation of machine 110, it is desirable to reverse the polarity to which transfer roller 142 is biased. For example, the polarity to which transfer roller 142 is biased is reversed to the same polarity as the toner particles, such as, for example, negative, during times when no image is being transferred. Doing so repels toner particles from the surface of the transfer roller 142 and thereby improves the efficiency with which transfer roller 142 is cleaned. Since conductive brush housing 164 is either directly biased to or indirectly charged to the same potential and polarity as transfer roller 142, reversing the polarity of transfer roller 142 also improves the efficiency with which toner particles are removed from conductive brush housing 164, such as, for example, by a vacuum system.

More particularly, the polarity to which transfer roller 142 is biased is reversed by reversing the polarity of the output of power supply 143. Conductive brush housing 164, as discussed above, is either directly biased to or indirectly acquires the same polarity as transfer roller 142. In the embodiments wherein conductive brush housing 164 is directly biased, reversing the polarity thereof is accomplished by reversing the polarity of the output of the biasing power supply (i.e., power supply 143 in FIG. 3 and power supply 173 in FIG. 6). In the embodiments wherein conductive brush housing 164 is not directly biased to the same polarity and charge as transfer roller 142 (i.e., the embodiments of FIGS. 7 and 8), polarity reversal thereof is accomplished by conductive housing 164 indirectly acquiring the reversed polarity of transfer roller 142.

The reversed (for example, negative) polarity applied to transfer roller 142 and applied to or acquired by conductive brush housing 164 must be quickly removed or dissipated at the end of a cleaning cycle in preparation for the next image transfer cycle. Failure to quickly and completely dissipate/remove the reversed polarity can result in reduced transfer current which degrades image transfer and reduces image quality.

In the embodiments of FIGS. 3 and 7 wherein conductive brush housing 164 is directly biased, discharge of the reverse polarity charge is expediently accomplished by returning the biasing power supply (power supply 143 in FIG. 3 and power supply 173 in FIG. 6) to the non-reverse polarity, as is more particularly described hereinafter.

In the embodiment shown in FIG. 8 wherein conductive brush housing 164 is connected to ground through a current limiting resistor 188, the reverse polarity charge is expediently bled off through resistor 188 to ground. This embodiment, however, requires that the biased conductive transfer roller cleaning brush also be expediently discharged, as is more particularly described hereinafter.

In order to expediently remove or dissipate the reverse bias of conductive housing 164 in the embodiment wherein conductive brush housing 164 is electrically floating and indirectly acquires or is indirectly charged to the same polarity as transfer roller 142 (i.e., the embodiment shown in FIG. 7) a discharge mechanism or circuit is required, as is also more particularly described hereinafter.

Figure 9:
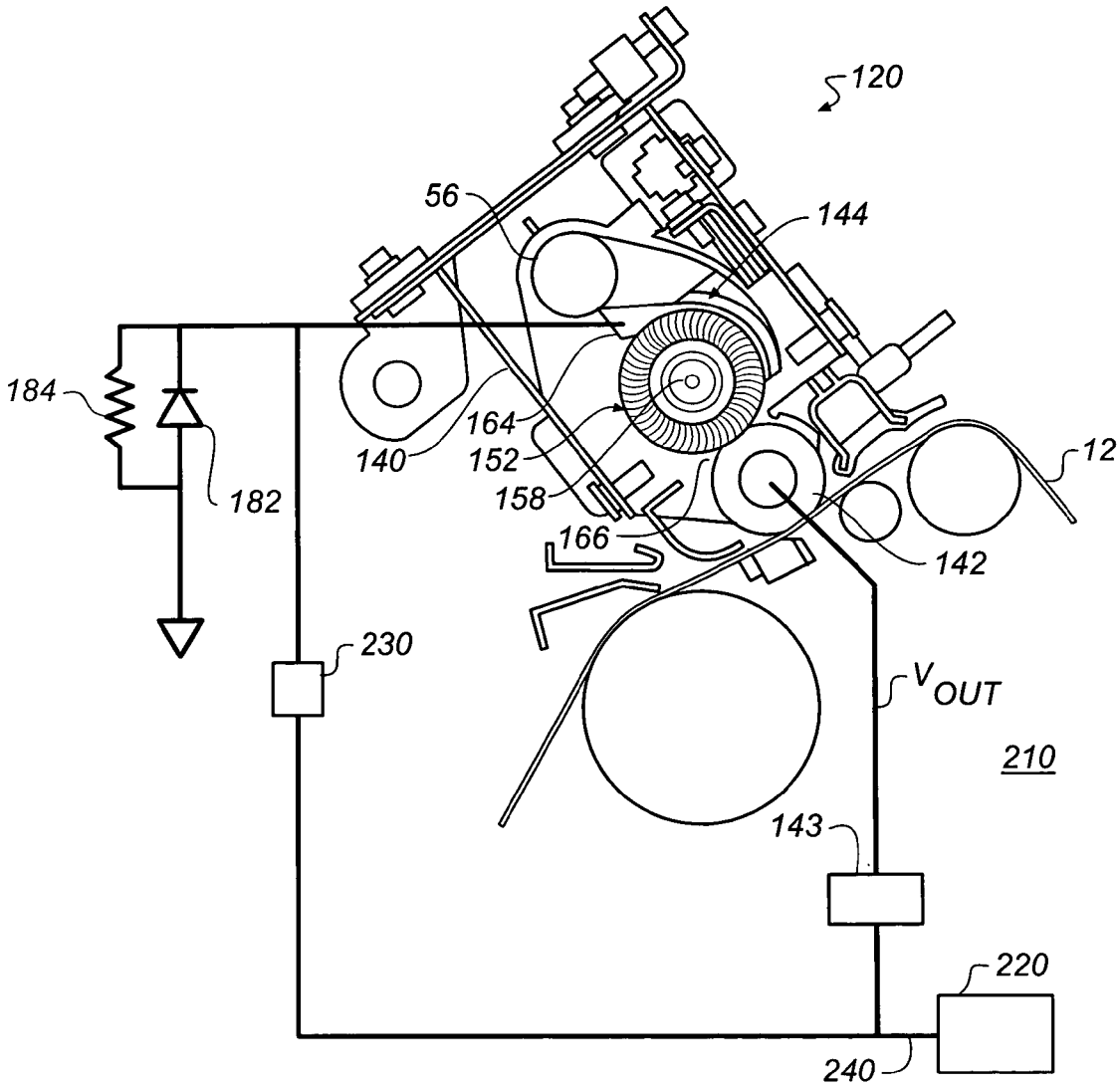
FIG. 9 is a schematic diagram of an electrophotographic machine having the roller transfer station or sub-system of the present invention and including one embodiment of a conductive housing discharge circuit of the present invention.

Referring now to FIG. 9, one embodiment of an electrophotographic machine 210 including a discharge circuit for discharging a reverse polarity charge of a conductive brush housing is shown. Machine 210 is configured generally similar to the embodiment of machine 110 shown in FIG. 7, and corresponding reference characters are used to indicate corresponding systems and/or parts shown therein. Machine 210 includes transfer roller 142, transfer roller power supply 143, conductive transfer roller cleaning brush 152, conductive brush housing 164, logic and control unit (LCU) 220 and discharge circuit 230.

More particularly, transfer roller 142 is electrically connected to and biased by transfer roller power supply 143, and conductive brush housing 164 is electrically connected to ground through high-voltage diode 182 and resistor 184 in parallel therewith. Thus, conductive brush housing 164 is electrically floating and acquires the same magnitude and polarity of electrical charge as transfer roller 142 by contact or close proximity with rotating conductive transfer roller cleaning brush 152. LCU 220 is the main logic and control circuitry of machine 210.

LCU 220 issues transfer roller power supply control signal 240 to transfer roller power supply 143. Control signal 240 controls the output of transfer roller power supply 143. More particularly, the magnitude and polarity of output voltage $V_{OUT}$ of transfer roller power supply 143 is dependent at least in part upon control signal 240. Thus, the magnitude and polarity to which transfer roller 142 is electrically charged is dependent at least in part upon control signal 240. For example, when control signal 240 is active, such as, for example, a logic hi level, transfer roller power supply 143 issues a relatively high magnitude and positive polarity output voltage $V_{OUT}$ to transfer roller power supply 142. Conversely, when control signal 240 is not active, such as, for example, a logic low level, transfer roller power supply 143 issues a reverse polarity output voltage $V_{OUT}$ to transfer roller power supply 142.

Discharge circuit 230 is also electrically connected to and receives control signal 240. Discharge circuit 230 selectively connects conductive brush housing 164 to ground responsive at least in part to control signal 240. More particularly, responsive at least in part to an active control signal 240, discharge circuit 230 maintains conductive brush housing 164 in an electrically floating condition. Conversely, responsive at least in part to an inactive control signal 240, discharge circuit 230 connects conductive brush housing 164 to ground potential.

Figure 10:
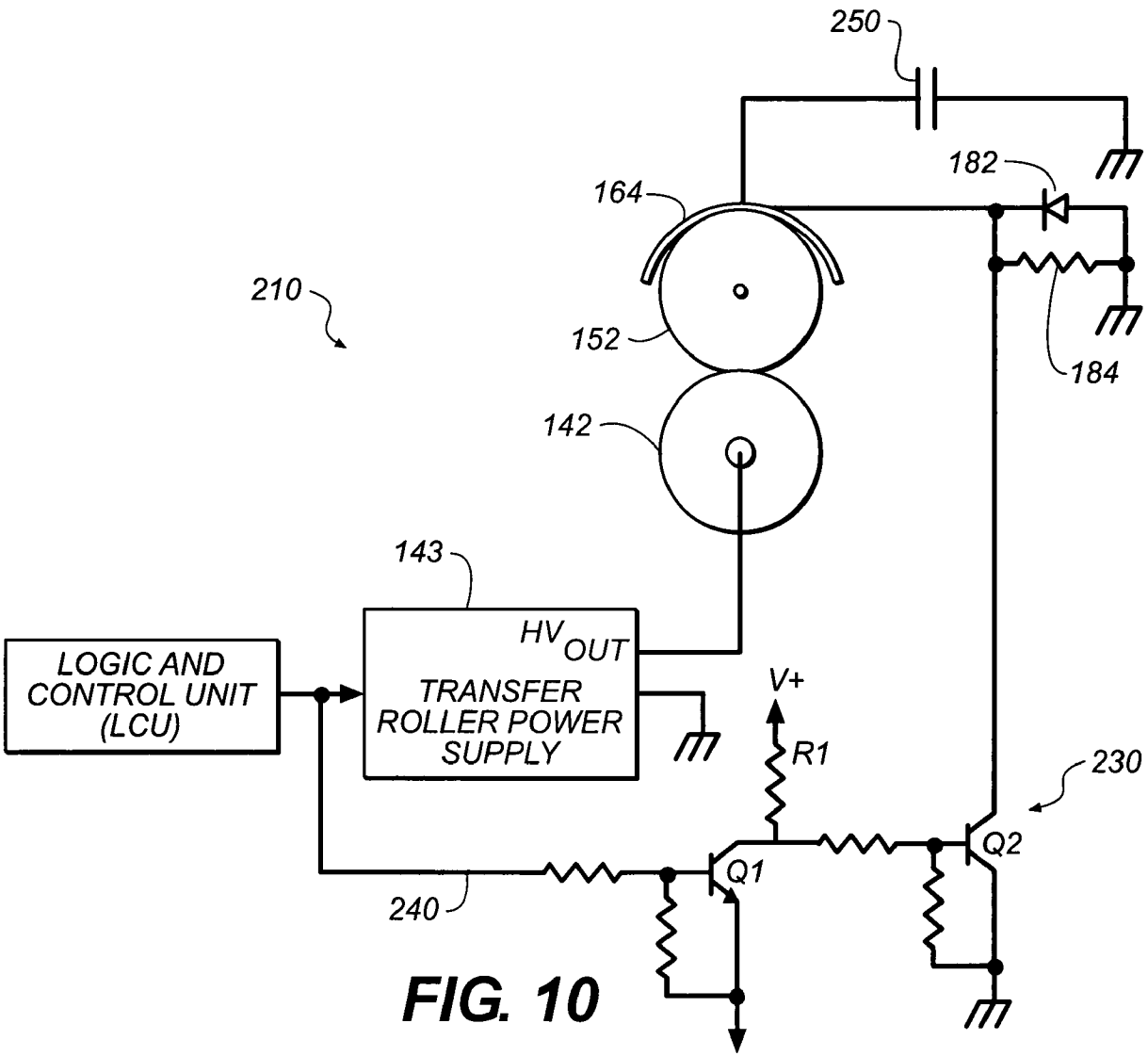
FIG. 10 is a schematic diagram of one embodiment of the discharge circuit of FIG. 9.

An exemplary embodiment of discharge circuit 230 is shown in FIG. 10. Discharge circuit 230 includes two transistors Q1 and Q2. Q1 is connected between a positive supply voltage V+, such as, for example, twenty four volts, and ground potential through a pull-up resistor R1. The base of Q1 is connected to and receives output control signal 240. Q2 is connected between conductive brush housing 164 and ground potential, with its base connected to the collector of Q1. When output control signal 240 is active, Q1 is forward biased and approximated by a short circuit connecting Q1 collector to emitter, whereas Q2 is approximated by an open circuit. Thus, when output control signal 240 is active conductive brush housing 164 remains electrically floating. Conversely, when output control signal 240 is inactive, Q1 is not forward biased and is approximated by an open circuit whereas Q2 is forward biased by positive supply voltage V+ and is approximated by a short circuit connecting Q2 collector to emitter. Thus, when output control signal 240 is inactive, conductive brush housing 164 is connected to ground potential and thereby discharged.

Although diode 182 would eventually become forward biased and thereby connect conductive brush housing 164 to ground potential when a sufficient level of reverse bias was acquired by conductive brush housing 164, discharge circuit 230 is a much faster and more robust way of selectively connecting conductive brush housing 164 to ground potential. Virtually as soon as output control signal 240 becomes inactive, signaling the need to discharge conductive housing 164, discharge circuit 230 connects conductive brush housing 164 to ground potential.

Referring again now to FIGS. 3 and 6, wherein conductive brush housing 164 is directly biased by power supply 143 and power supply 173, respectively, discharge circuit 230 is connected between conductive brush housing 164 and ground. Alternatively, and as shown in dashed lines in FIGS. 3 and 6, the power supplies are electrically connected to and receive control signal 240 and, dependent at least in part thereon, re-bias conductive brush housing 164 and thereby expediently eliminate the reverse bias.

Referring again now to FIG. 8, the embodiment of machine 110 shown therein expediently bleeds off the reverse polarity charge on conductive brush housing 164 through resistor 188 to ground. However, in that embodiment, conductive transfer roller cleaning brush 152 is directly biased to the reverse polarity. Thus, discharge circuit 230 is electrically connected between conductive transfer roller cleaning brush 152 and ground in order to expediently discharge the reverse bias thereon. Alternatively, and as shown in dashed lines in FIG. 8, power supply 193 is electrically connected to and receives control signal 240 and, dependent at least in part thereon, re-biases conductive transfer roller cleaning brush 152, and thereby conductive brush housing 164 and thereby expediently eliminate the reverse bias.

It is also desirable to selectively discharge conductive brush housing 164 to ground potential under other circumstances, such as, for example, when machine 210 is opened for service or maintenance. As shown in FIG. 10, machine 210 includes switch 240, which is electrically connected between conductive brush housing 164 to ground. Switch 240 is configured as, for example, a normally-closed switch, and is physically disposed in such a manner that the case or an access panel of machine 210 holds switch 240 open. Thus, when a service engineer opens the case or access panel, switch 240 is no longer held open and will close, thereby connecting conductive brush housing 164 to ground through an optional current-limiting resistor (not shown).

While this invention has been described as having a preferred design, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

What is claimed is:

1. An electrophotographic machine, comprising:

a dielectric member configured for carrying a toner image;

a transfer roller engaging said dielectric member and being configured for transferring the toner image to an image substrate;

a transfer roller power supply biasing and periodically reverse biasing said transfer roller;

a transfer roller cleaning brush having a plurality of bristles engaging said transfer roller, at least some of said bristles being electrically conductive bristles;

an electrically conductive brush housing enclosing said transfer roller cleaning brush, said brush housing defining an opening through which said bristles contact said transfer roller;

a charging mechanism for electrically charging said brush housing to substantially the same electrical potential as said transfer roller; and a discharge mechanism for selectively discharging said brush housing.

2. The electrophotographic machine of claim 1, further comprising a logic control unit issuing an output control signal to said transfer roller power supply and to said discharge mechanism, said transfer roller power supply reverse biasing said transfer roller dependent at least in part upon said output control signal.

3. The electrophotographic machine of claim 2, wherein said brush housing is electrically floating.

4. The electrophotographic machine of claim 3, wherein said discharge mechanism connects said brush housing to ground potential responsive at least in part to said output control signal.

5. The electrophotographic machine of claim 3, wherein said discharge mechanism comprises a transistor circuit electrically connected between said brush housing and ground potential, and receiving said output control signal.

6. The electrophotographic machine of claim 2, wherein said discharge mechanism comprises a power supply electrically connected to and biasing said brush housing, and receiving said output control signal, said power supply issuing an output voltage that is dependent at least in part upon said output control signal.

7. An image transfer station for an electrophotographic machine, said machine having a dielectric member configured for carrying a toner image and a logic control unit issuing an output control signal, said image transfer station comprising:

a transfer roller configured for engaging said dielectric member and for transferring the toner image to an image substrate, said transfer roller being biased, said bias dependent at least in part upon said output control signal;

a transfer roller cleaning brush having a plurality of bristles engaging said transfer roller, at least some of said bristles being electrically conductive bristles;

an electrically conductive brush housing enclosing said transfer roller cleaning brush, said brush housing defining an opening through which said bristles contact said transfer roller, said brush housing configured for being electrically charged to substantially the same electrical potential as said transfer roller; and a discharge mechanism responsive at least in part to said output control signal for selectively discharging said brush housing.

8. The electrophotographic machine of claim 7, further comprising a logic control unit issuing an output control signal to said transfer roller power supply and to said means for selectively discharging, said transfer roller power supply reverse biasing said transfer roller dependent at least in part upon said output control signal.

9. The electrophotographic machine of claim 8, wherein said means for selectively discharging comprises a power supply electrically connected to and biasing said transfer roller cleaning brush, said power supply receiving said output control signal, said power supply issuing an output voltage that is dependent at least in part upon said output control signal.

10. The electrophotographic machine of claim 9, wherein said brush housing is electrically connected to ground potential.

11. A method of cleaning an electrically-biased transfer roller in an electrophotographic machine, comprising:

engaging the transfer roller with bristles of a rotating transfer roller cleaning brush, at least some of said bristles being electrically conductive;

enclosing the transfer roller cleaning brush in an electrically conductive brush housing, the bristles engaging the brush housing, the bristles engaging the transfer roller through an opening in the housing; and charging at least one of the transfer roller cleaning brush and the brush housing to substantially the same electrical potential as the transfer roller;

periodically reversing the polarity of the biased transfer roller and of the charge on the at least one of said transfer roller cleaning brush and said brush housing which has been charged to substantially the same electrical potential as the transfer roller; and discharging the reverse polarity charge of the at least one of said transfer roller cleaning brush and said brush housing.

12. The method of claim 11, wherein said periodically reversing step and said discharging step occur responsive at least in part to an output control signal of the machine.

* * * * *